US010194245B1

(12) United States Patent
Pircaro

(10) Patent No.: US 10,194,245 B1
(45) Date of Patent: Jan. 29, 2019

(54) ACOUSTIC TRANSDUCER WITH VIBRATION DAMPING

(71) Applicant: Bose Corporation, Framingham, MA (US)

(72) Inventor: Mark A. Pircaro, Yuma, AZ (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/663,343

(22) Filed: Jul. 28, 2017

(51) Int. Cl.

| | |
|---|---|
| ***H04R 25/00*** | (2006.01) |
| ***H04R 1/20*** | (2006.01) |
| ***H04R 1/00*** | (2006.01) |
| ***H04R 9/06*** | (2006.01) |
| ***H04R 11/02*** | (2006.01) |
| ***H04R 7/12*** | (2006.01) |
| ***H04R 31/00*** | (2006.01) |
| ***H04R 1/28*** | (2006.01) |

(52) U.S. Cl.
CPC ..... *H04R 7/12* (2013.01); *H04R 1/2857* (2013.01); *H04R 31/003* (2013.01); *H04R 2231/001* (2013.01); *H04R 2307/204* (2013.01)

(58) Field of Classification Search
CPC ..... H04R 1/2857; H04R 7/12; H04R 31/003
USPC ..... 381/423
See application file for complete search history.

(56) References Cited

U.S. PATENT DOCUMENTS

| | | | | |
|---|---|---|---|---|
| 982,027 A | | 1/1911 | Young | |
| 1,757,451 A | | 5/1930 | Crane | |
| 1,917,309 A | | 7/1933 | Leopold | |
| 1,997,790 A | * | 4/1935 | Heidrich | H04R 7/122 181/163 |
| 2,732,908 A | * | 1/1956 | Brittain | H04R 7/12 181/168 |
| 3,093,207 A | | 6/1963 | Bozak | |
| 4,020,299 A | | 4/1977 | Gamer et al. | |
| 4,562,899 A | | 1/1986 | Nakamura | |
| 4,581,496 A | | 4/1986 | Sweany | |
| 4,709,392 A | * | 11/1987 | Kato | H04R 7/26 181/157 |
| 4,989,254 A | * | 1/1991 | Amalaha | H04R 1/345 381/182 |
| 5,249,237 A | * | 9/1993 | Paddock | H04R 9/047 381/186 |
| 5,304,746 A | | 4/1994 | Purvine | |

(Continued)

FOREIGN PATENT DOCUMENTS

| | | |
|---|---|---|
| CN | 105376679 A | 6/2006 |
| CN | 201171234 U | 12/2008 |

(Continued)

OTHER PUBLICATIONS

International Search Report and the Written Opinion of the International Searching Authority, International Application No. PCT/US2018/043502, pp. 1-15, dated Oct. 12, 2018.

*Primary Examiner* — Khai N. Nguyen
(74) *Attorney, Agent, or Firm* — Bond, Schoeneck & King, PLLC

(57) ABSTRACT

Circumferential mode vibrations, in a diaphragm of an acoustic transducer, are damped by defining at least one elongated opening extending radially along a portion of a length from the central area to the outer perimeter being covered by a material having higher damping properties than the material of the cone.

6 Claims, 7 Drawing Sheets

(56) References Cited

U.S. PATENT DOCUMENTS

| | | | | |
|---|---|---|---|---|
| 5,827,965 | A * | 10/1998 | Nakagawa | G01C 19/56 73/488 |
| 7,266,211 | B2 * | 9/2007 | Ikeuchi | H04R 1/023 181/176 |
| 7,903,834 | B1 * | 3/2011 | Graber | H04R 1/403 381/334 |
| 9,544,697 | B2 * | 1/2017 | Uchida | H04R 19/04 |
| 2003/0106740 | A1 | 6/2003 | Tabata et al. | |
| 2004/0042633 | A1 * | 3/2004 | Sato | H04R 9/06 381/423 |
| 2005/0078850 | A1 | 4/2005 | Norton | |
| 2006/0070796 | A1 | 4/2006 | Frasl | |
| 2012/0269379 | A1 | 10/2012 | Gao et al. | |
| 2015/0078592 | A1 * | 3/2015 | Uchida | H04R 19/04 381/191 |
| 2016/0029128 | A1 | 1/2016 | Pircaro | |

FOREIGN PATENT DOCUMENTS

| | | | |
|---|---|---|---|
| CN | 101516052 | B | 8/2009 |
| CN | 202121764 | U | 5/2011 |
| CN | 102170603 | B | 8/2011 |
| CN | 202103836 | U | 1/2012 |
| DE | 4201040 | | 7/1993 |
| EP | 1711031 | A1 | 11/2006 |
| GB | 311044 | | 12/1928 |

* cited by examiner

ACOUSTIC TRANSDUCER WITH VIBRATION DAMPING

BACKGROUND

The disclosure relates to audio systems and related devices and methods, and, particularly, to an acoustic transducer with circumferential mode vibration damping.

SUMMARY

All examples and features mentioned below can be combined in any technically possible way.

In one aspect, an acoustic transducer includes a diaphragm made of a first material having a central area and an outer perimeter, at least one elongated opening in the diaphragm extending substantially radially along a portion of a length from the central area to the outer perimeter; and a surround, comprised of a foam material having relatively higher damping characteristics than the first material, arranged circumferentially about the outer perimeter of the diaphragm, wherein the surround comprises at least one projection extending from the outer perimeter toward the central area of the diaphragm, wherein the at least one projection is arranged to cover the at least one elongated opening. The at least one projection may include a plurality of projections and the at least one elongated opening may include a plurality of elongated openings, each projection of the plurality of projections covering a respective elongated opening of the plurality of elongated openings. The diaphragm may include only one elongated opening. The at least one projection may cover a portion of an outer surface of the diaphragm.

Embodiments may include at least one tinsel coupled to the diaphragm, wherein the diaphragm has a center of mass and an axis of symmetry, the at least one tinsel being and the at least one elongated opening, at least in part, being located on the opposite side of the axis of symmetry such that the center of mass of the diaphragm lies on or near the axis of symmetry.

Embodiments may include at least one elongated depression formed in the diaphragm, extending substantially radially along a portion of a length from the central area to the outer perimeter and including a first wall, a second wall, and a floor extending between the first wall and the second wall.

In another aspect, an acoustic transducer may include a diaphragm made of a first material having a central area, an outer perimeter, a center of mass, and an axis of symmetry; at least one tinsel coupled to the diaphragm on one side of the axis of symmetry; and at least one elongated opening in the diaphragm extending substantially radially along a portion of a length from the central area to the outer perimeter and positioned, at least in part, on the opposite side of the axis of symmetry as the at least one tinsel, such that the center of mass lies on or near the axis of symmetry. The at least one elongated opening may be covered with a second material having relatively higher damping characteristics than the first material. The diaphragm may include only one elongated opening.

Embodiments may include a surround, having relatively higher damping characteristics than the first material, arranged circumferentially about the outer perimeter of the diaphragm, wherein the surround comprises at least one projection extending from the outer perimeter toward the central area of the diaphragm, wherein the at least one projection is arranged to cover the at least one elongated opening. The at least one projection may include a plurality of projections and the at least one elongated opening may include a plurality of elongated openings, each projection of the plurality of projections covering a respective elongated opening of the plurality of elongated openings. The surround may be comprised of a foam material.

Embodiments may include at least one elongated depression formed in the diaphragm, extending substantially radially along a portion of a length from the central area to the outer perimeter and including a first wall, a second wall, and a floor extending between the first wall and the second wall.

In another aspect, an acoustic transducer includes a diaphragm made of a first material having a central area, an outer perimeter, a center of mass, and an axis of symmetry; and at least one elongated depression formed in the diaphragm, extending substantially radially along a portion of a length from the central area to the outer perimeter and including a first wall having a first depth, a second wall having a second depth, and a floor extending between the first wall and the second wall. The first depth and the second depth may be different. The at least one elongated depression may be covered with a second material having relatively higher damping characteristics than the first material.

Embodiments may include a surround, having relatively higher damping characteristics than the first material, arranged circumferentially about the outer perimeter of the diaphragm, wherein the surround comprises at least one projection extending from the outer perimeter toward the central area of the diaphragm, wherein the at least one projection is arranged to cover the at least one elongated depression. The at least one projection may include a plurality of projections and the at least one elongated depression may include a plurality of elongated depressions, each projection of the plurality of projections covering a respective elongated depression of the plurality of elongated depressions. The surround may be comprised of a foam material.

Embodiments may include at least one tinsel, wherein the diaphragm has a center of mass and an axis of symmetry, the at least one tinsel being and the at least one elongated depression, at least in part, being located on the opposite side of the axis of symmetry such that the center of mass of the diaphragm lies on or near the axis of symmetry.

DETAILED DESCRIPTION

This disclosure is based, at least in part, on the realization that circumferential mode vibrations of an electro-acoustic transducer diaphragm may be dampened by introducing discontinuities that interrupt the diaphragm azimuthally. This may be accomplished, for example, by introducing one or more elongated openings, each bridged with a lossy damping material, that extend radially from a central area of the transducer diaphragm to the outer perimeter of the diaphragm. The lossy damping material may be formed from projections extending from a foam surround disposed circumferentially about the outer perimeter. In addition, the elongated openings may be arranged to compensate for additional mass, such as tinsels, added to the diaphragm asymmetrically, such that the center of mass of the diaphragm is arranged on or near an axis of symmetry. The discontinuities may, alternatively, be formed from depressions defined in the surface of the transducer diaphragm. The depressions may have two sidewalls and a floor extending between them.

Figure 1:
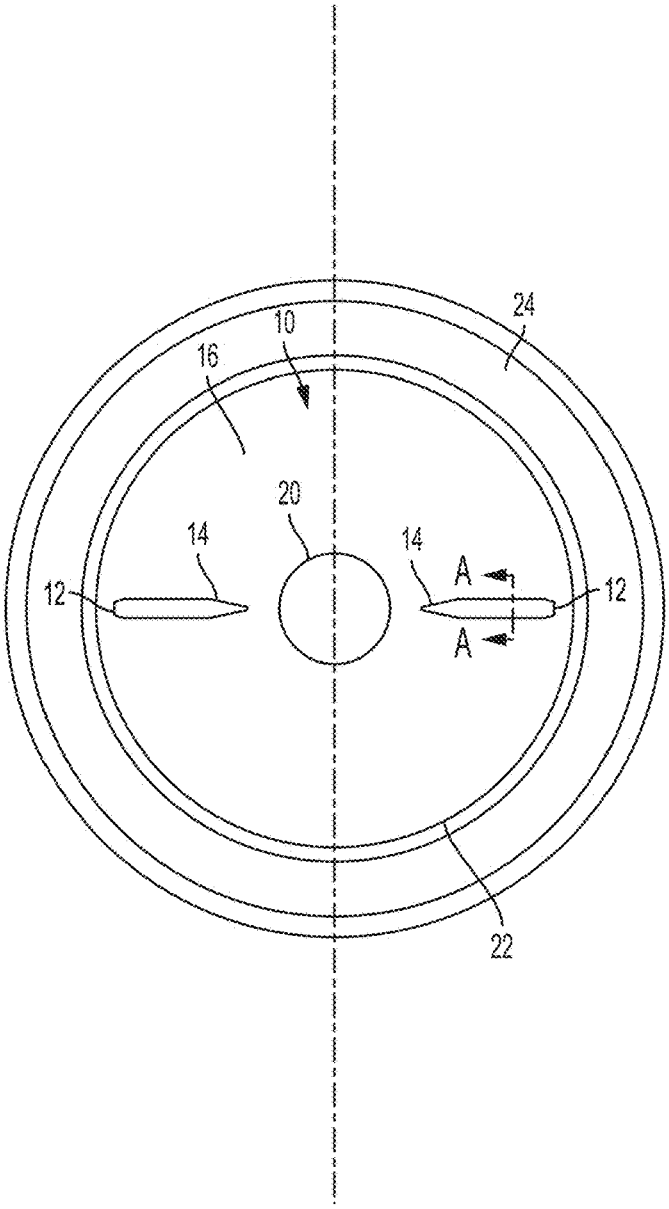
FIG. 1 is a perspective view of an example diaphragm for use in an electro-acoustic transducer.

FIG. 1 depicts an acoustic transducer comprising a diaphragm 10 having at least one elongated opening 12 extending substantially radially along diaphragm 10 and covered with a lossy damping material 14. Elongated openings 12 and damping material 14 serve to dampen the circumferential mode vibrations experienced by diaphragm 10 during use. Although only two elongated openings 12 are shown in FIGS. 1 and 2, any number of elongated openings 12 may be defined in diaphragm 10.

Figure 2:
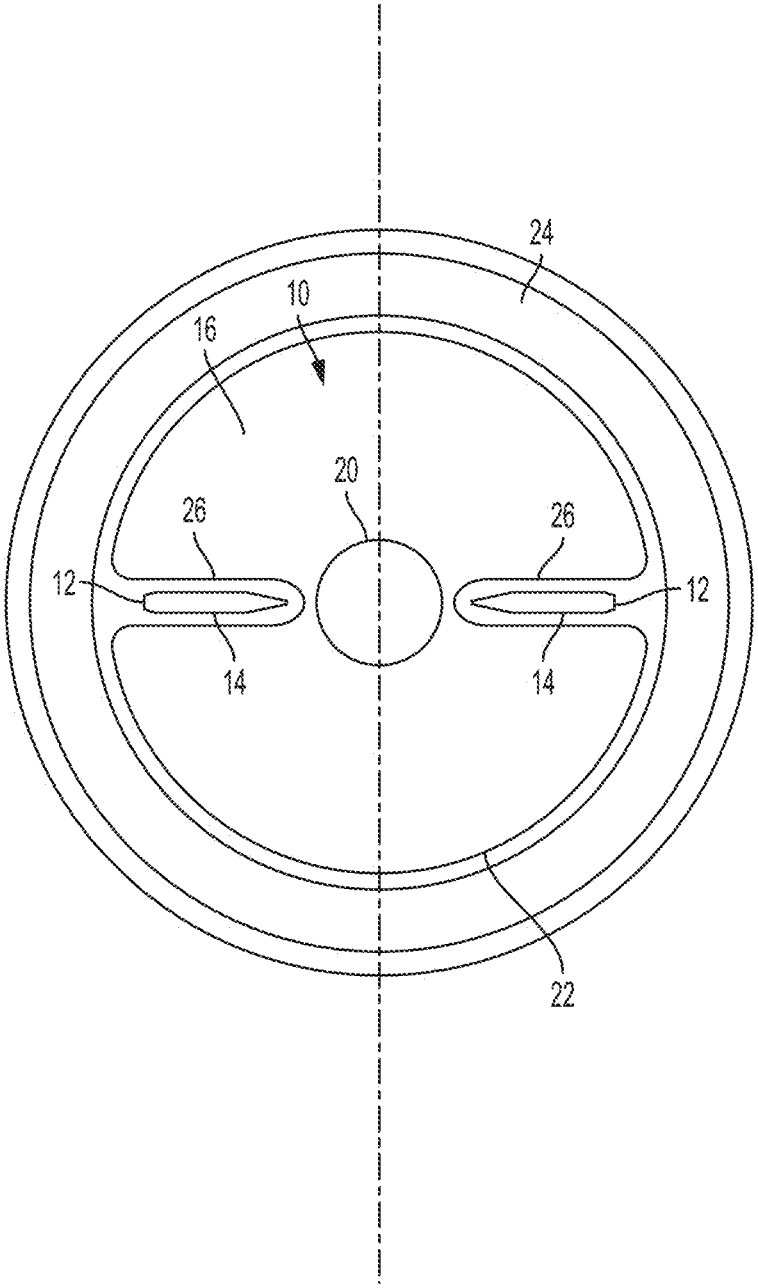
FIG. 2 is a perspective view of an example diaphragm, including covering projections extending from a surround, for use in an electro-acoustic transducer.

Diaphragm 10 as shown in FIGS. 1 and 2, may define an inner surface 16 and an outer surface 18 (shown, for example, in FIGS. 3A through 3C), as well as central area 20 and an outer perimeter 22. Diaphragm 10 may be generally frustoconical: that is to say, a cone with its vertex removed. In alternate examples, diaphragm 10 may be domed or flat. Furthermore, diaphragm 10 may be circular, ovular, or any other shape suitable for producing audio and which experiences circumferential mode vibrations. In the example of the frustoconical diaphragm 10, central area 20 may be a circular opening in the center, or an area surrounding the circular opening.

A surround 24, comprised of foam or other lossy material, may be disposed circumferentially about outer perimeter 22. Damping material 14 may be formed from the same material as surround 24. For example, as shown in FIG. 2, surround 24 may define a plurality of projections 26, each of which extend from the outer perimeter 22 of diaphragm 10 toward the central area 20 of diaphragm 10 in a covering relation with elongated opening 12. In one example, projections 26 may be finger-like (i.e., relatively long and narrow), each projection 26 extending over a single elongated opening 12. In other examples, each projection 26 may be wide and cover a larger area of the surface (inner 16, outer 18, or both) of diaphragm 10, as well as multiple elongated openings 12.

Figure 3A:
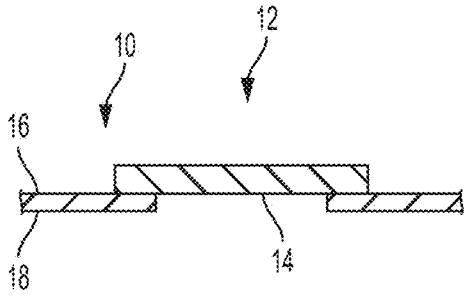
FIG. 3A is a cross-sectional view of the example diaphragm of FIG. 1 taken along line A-A.
Figure 3B:
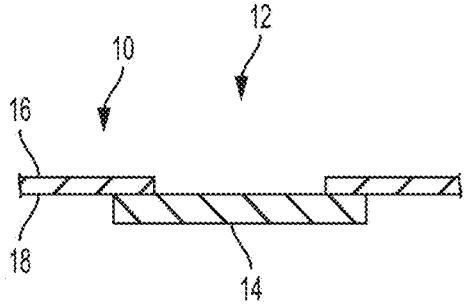
FIG. 3B is a cross-sectional view of the example diaphragm of FIG. 1 taken along line A-A.
Figure 3C:
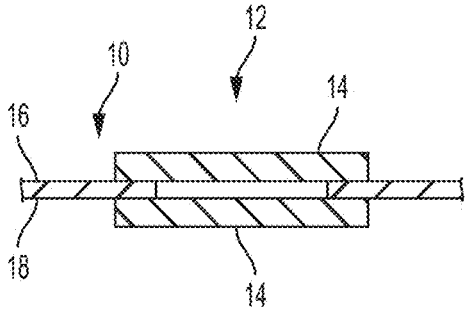
FIG. 3C is a cross-sectional view of the example diaphragm of FIG. 1 taken along line A-A.

FIGS. 3A through 3C depict a cross-sectional view of diaphragm 10 as taken along line A-A of FIG. 1. As shown, damping material 14 may be formed on and cover either inner surface 16 of diaphragm 10 (FIG. 3A), outer surface 18 of diaphragm 10 (FIG. 3B), or both sides of diaphragm 10 (FIG. 3C). Damping material 14 may be foam (for example, the same foam as the surround 24), rubber, plastic, or any material having a Young's modulus lower than diaphragm 10 and/or having a larger internal loss, and suitable for covering diaphragm 10. Damping material 14, in an example, may have a Young's modulus that is one tenth the Young's modulus of diaphragm 10 and/or with a higher loss factor. However, in other examples, the Young's modulus of damping material 14 may be less than or greater than one tenth of the Young's modulus of diaphragm 10.

In the examples shown in FIGS. 3A through 3C, damping material 14 only covers, but does not extend into, elongated openings 12. This allows damping material 14 to be quickly and easily fixed to diaphragm, with, for example, an adhesive such as a glue or tape. Furthermore, damping material need not necessarily extend over the entirety of elongated openings 12 but may instead cover only a portion of the elongated openings 12.

In one example, damping material 14 may be only large enough to cover the edges of elongated opening to permit affixing to diaphragm 10. However, in alternate examples, damping material 14 may be large enough to encompass the edges and area surrounding elongated openings 12 or large enough to cover a large portion or all of diaphragm 10. Damping material 14 may be fixed locally to the edges of the elongated openings 12; however, if damping material 14 is much larger than the elongated opening 12 that it covers, damping material 14 may be fixed at a point that is relatively remote from the elongated openings 12, such as along outer perimeter 22 and central area 20.

The position of elongated openings 12 may also be varied azimuthally around diaphragm 10. Since damping material 14 adds mass to diaphragm 10, elongated openings 12 may be positioned symmetrically to retain the center of mass on or near the axis of symmetry of the moving assembly. Thus, as shown in FIGS. 1 and 2, two elongated openings 12 may be positioned 180° apart. If diaphragm 10 defines four elongated openings 12, the elongated openings may be placed 90° apart. Any number of elongated openings may be defined in this way—dividing diaphragm 10 such that elongated openings 12 are placed symmetrically about diaphragm 10.

Figure 4:
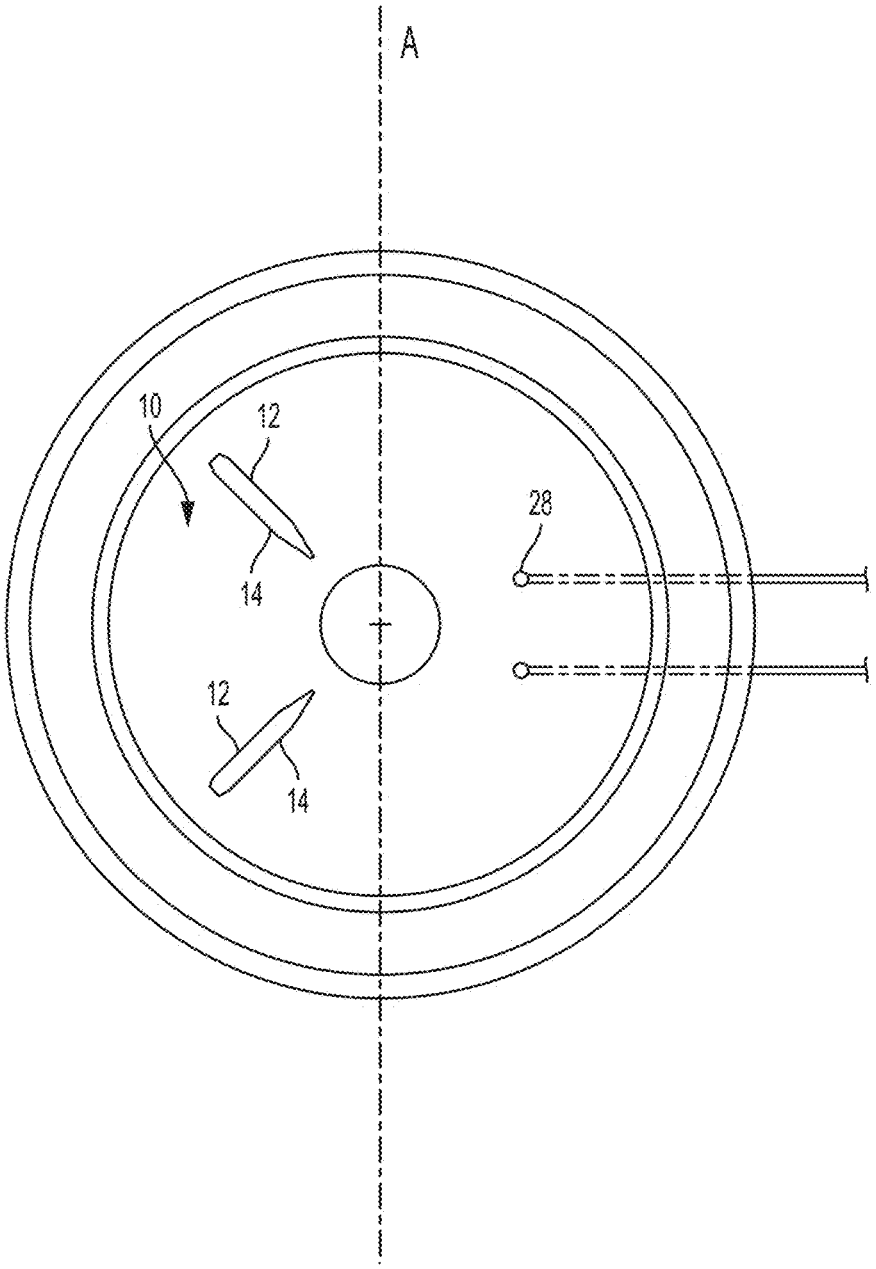
FIG. 4 is a perspective view of an example diaphragm for use in an electro-acoustic transducer.

Alternately, elongated openings 12 may be positioned asymmetrically about diaphragm 10. For example, elongated openings 12 may be positioned to account for additional asymmetrical mass located on or around diaphragm 10, such as tinsels or other features, in order to retain the center of mass on or near the axis of symmetry. An example of such a positioning is shown in FIG. 4. As shown, diaphragm 10 may define an axis of symmetry A, bisecting diaphragm 10. Tinsels 28 may be attached to diaphragm 10 on one side of the axis of symmetry A such that the center of mass of diaphragm 10 is shifted away from the axis of symmetry A, causing a mass imbalance on diaphragm 10. Two elongated openings 12 may thus be positioned on the opposite side of axis of symmetry A to counterbalance the mass imbalance and shift the center of mass back on, or near, the axis of symmetry A. In another example, the elongated openings 12 may be arranged to shift the center of mass to the center of diaphragm 10. It should be noted that the positions of elongated openings 12 shown in FIG. 3 are merely examples and any number of elongated openings 12 may be positioned on diaphragm 10 to ensure the center of mass is located on or near the axis of symmetry of diaphragm 10.

Asymmetrical positioning of elongated openings 12 may also serve to interrupt the periodicity of circumferential breakup modes and thus result in greater damping of the circumferential modes. For example, diaphragm 10 may include two elongated openings 12 that are positioned at points besides 180° apart, such as 100° apart or 143° apart.

Similarly, any number of elongated openings 12 may be defined in diaphragm 10 at asymmetrical positions around diaphragm 10. Furthermore, even if elongated openings 12 are positioned about diaphragm 10 asymmetrically, damping material 14 may extend beyond the region local to elongated openings 12 in a manner that distributes the mass of damping material 14 symmetrically in order to retain the enter of mass on or near the axis of symmetry.

The damping of the circumferential mode vibration is defined by the cumulative width of elongated openings 12 (in other words, the sum of the widths of each elongated opening 12) rather than the number of elongated openings 12. Thus, the cumulative width of the elongated openings 12 is preferably substantially equal to a predetermined value in order to optimize damping of the circumferential mode vibration. The predetermined value may be a function of the radius of the cone: thus, as the radius of the cone increases, the cumulative width of the elongated openings 12 may increase accordingly.

The diaphragm 10 may therefore have any number of elongated openings so long as the cumulative width substantially sums to a predetermined value dependent upon the radius of the cone. For example, the cumulative width of elongated openings 12 of a six-inch diaphragm 10 may be 4 mm, while the cumulative width of elongated openings 12 of an eight-inch diaphragm 10 may be 8 mm. According to an example, the optimized cumulative width of elongated openings 12 may not necessarily increase proportionally with the radius of diaphragm 10, but may be dependent upon some other function of the radius of diaphragm 10. Diaphragm 10 may thus define a single elongated opening 12 with a width equaling the predetermined value, or it may have several elongated openings, the sum of the widths equaling the predetermined value. Stated differently, diaphragm 10 may define very few relatively wide openings or more relatively narrow openings, both examples having the same cumulative width and resulting in identical or very similar damping of the circumferential modes. With this in mind, diaphragm 10 may be manufactured to define very few elongated openings. Indeed, diaphragm 10 may define only a single elongated opening.

Each elongated opening 12 need not be the same width as each other elongated opening 12. For example, one elongated opening 12 may be relatively narrow, while another elongated opening 12 may be relatively wide, as long as the sum of the widths equals the optimized predetermined value. Similarly, some circumferential mode vibrations may require more damping than others. Thus, the cumulative width may be greater at certain points along the length radially extending from central area 20 to outer perimeter 22. For example, the cumulative width of the elongated openings 12 from the central area 20 to halfway toward outer perimeter 22 may be 4 mm wide, while the cumulative width of elongated openings 12 from halfway toward outer perimeter 22 to outer perimeter 22 may total 8 mm wide.

The length and the radial location of each elongated opening 12 on diaphragm 10 will also have a large bearing on mechano-acoustic behavior with respect to far-field acoustic frequency response anomalies. With this in mind, the length and placement of elongated openings 12 may be dependent upon which circumferential modes are to be damped and the desired behavior and frequency response of diaphragm 10. Elongated openings 12 may thus cover only a portion of the length of diaphragm 10 radially extending from central area 20 to outer perimeter 22 in order to dampen only certain circumferential mode vibrations. For example, elongated openings 12 may terminate at one side 7-12 mm from central area 20 and may terminate at the other side approximately 5 mm from the outer perimeter 22. In alternate examples, elongated openings 12 may be shifted nearer to the central area 20 or nearer to the outer perimeter 22 to cover certain circumferential modes.

Furthermore, different sets of elongated openings 12 may be employed to dampen non-contiguous circumferential modes. For example, the diaphragm 10 may be define a first opening or set of elongated openings 12 located along a first portion of the length radially extending from central area 20 and outer perimeter 22 and a second elongated opening 12 or set of openings 12 located along a different part of the length radially extending from central area 20 and outer perimeter 22—each set damping a circumferential mode non-contiguous to the vibrational mode damped by another set. Any number of elongated openings 12 or sets of elongated openings 12 may be defined in this way.

As previously described, elongated opening 12 is only one example of a discontinuity that can affect damping of the circumferential modes. In an alternate example, as shown in the cross-sectional view of FIGS. 5A and 5B, instead of openings, diaphragm 10 may define at least one elongated depression 30 in the substrate of the diaphragm 10. As shown, depressions 30 may extend outward from either the inner surface (FIG. 5A) or outer surface (FIG. 5B) of diaphragm. Furthermore, elongated depressions 30 may not necessarily include a damping material 14 covering elongated depression 30, although in some examples elongated depressions 30 may, at least partially, be covered with such a damping material 14. Indeed, depressions 30 may be covered with projections extending from surround 24.

Figure 5A:
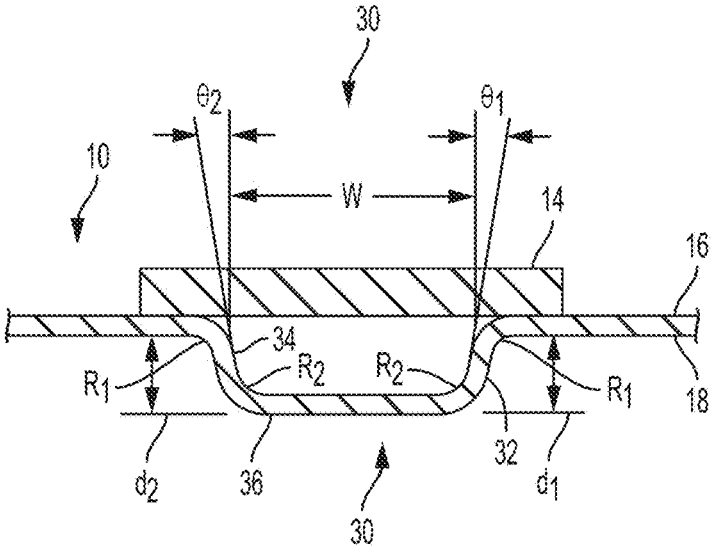
FIG. 5A is a cross-sectional view of the example diaphragm of FIG. 1 taken along line A-A.
Figure 5B:
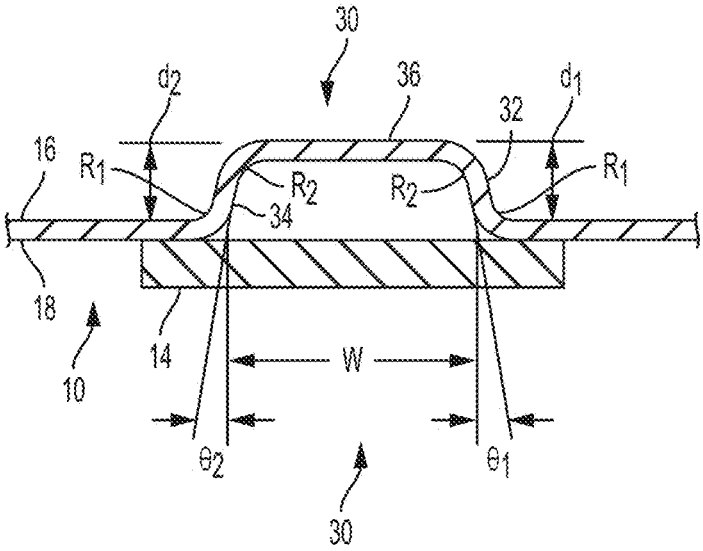
FIG. 5B is a cross-sectional view of the example diaphragm of FIG. 1 taken along line A-A.

Elongated depressions 30 may be generally bathtub-shaped and may thus include a first wall 32, a second wall 34, and a floor 36 extending between the first wall 32 and second wall 34. The shape of elongated depression 30 may be defined by a variety of parameters, as shown in FIGS. 5A and 5B, such as width w, depths $d_1$ and $d_2$, angles $\theta_1$ and $\theta_2$, and the radius of the corners $R_1$ and $R_2$. More specifically, first wall 32 may have a depth $d_1$, and may extend at an angle $\theta_1$ with respect to a line normal to the surface 16 of diaphragm 10. Similarly, second wall 34 may have a depth $d_2$ and may extend at an angle $\theta_2$ with respect to a line normal to the surface 16 of diaphragm 10. Furthermore, elongated depressions 30 may define corners at the boundaries of first wall 32 and inner surface 16, and second wall 34 and inner surface 16, each having a radius $R_1$. Similarly, elongated depressions 30 may define corners at the boundaries of first wall 32 and floor 36, and second wall 34 and floor 36, each having a radius $R_2$. The radii $R_1$ and $R_2$ may be dependent, at least in part, on the values of $\theta_1$ and $\theta_2$ and depths $d_1$ and $d_2$, respectively. Each of these parameters may be varied with respect to each other to achieve varying damping properties. Indeed, elongated depression 30 need not be symmetrical about a given axis. For example, depression 30 may feature left-right asymmetry by varying the respective values of $\theta_1$ and $\theta_2$, or depths $d_1$ and $d_2$, or radii R1 and R2, on each side.

Elongated depression 30 need not be necessarily bathtub-shaped as shown in FIGS. 5A and 5B, but may instead be implemented in any shape that is suitable for damping the circumferential mode vibrations of diaphragm 10. Diaphragm 10 may define any other discontinuity which interrupts diaphragm azimuthally in a way suitable for damping circumferential mode vibrations of diaphragm 10.

Diaphragm 10 need not exclusively feature only elongated openings 12 or depressions, but may, in some examples, define both. Further, as described with respect to the elongated openings above, the positioning of elongated depressions 30 may be varied azimuthally or radially along diaphragm 10 to dampen certain noncontiguous modes or to account for the mass added by tinsels or other features. Diaphragm 10 need not define depressions that are each the same size or shape.

Figure 6:
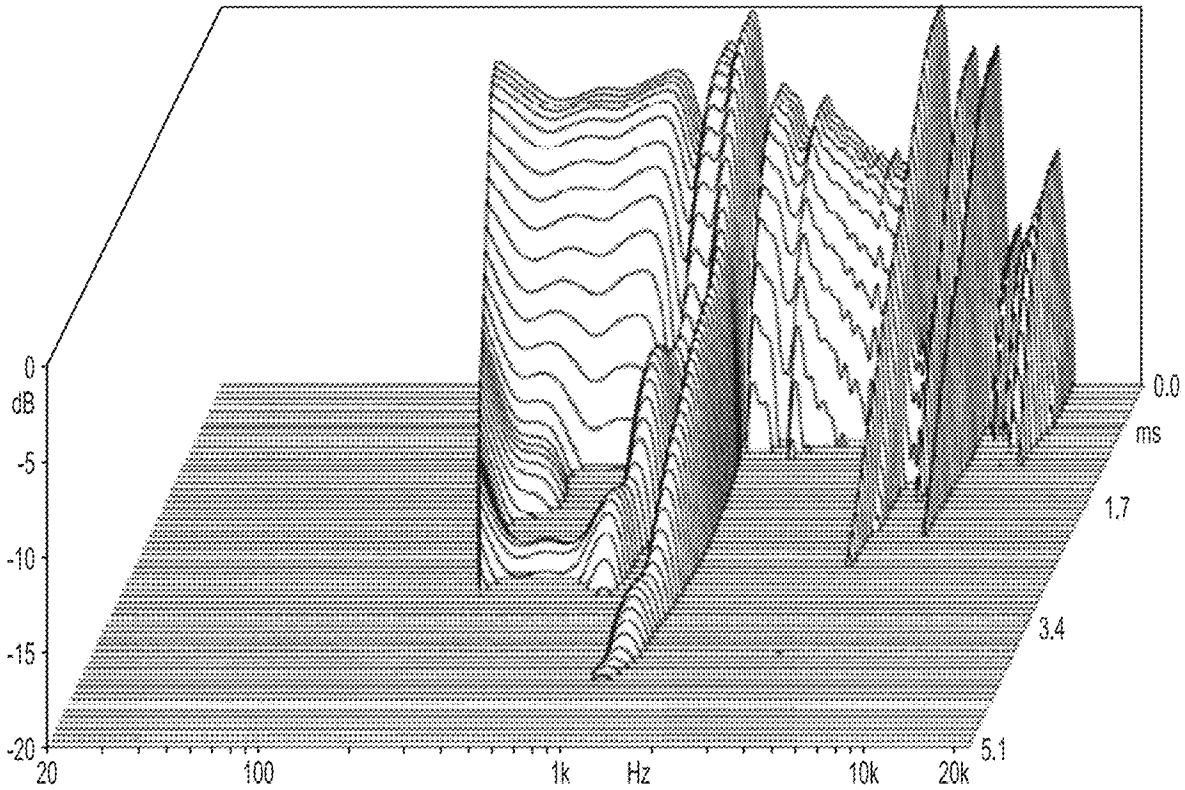
FIG. 6 is plot of a cumulative spectral decay of an example diaphragm.
Figure 7:
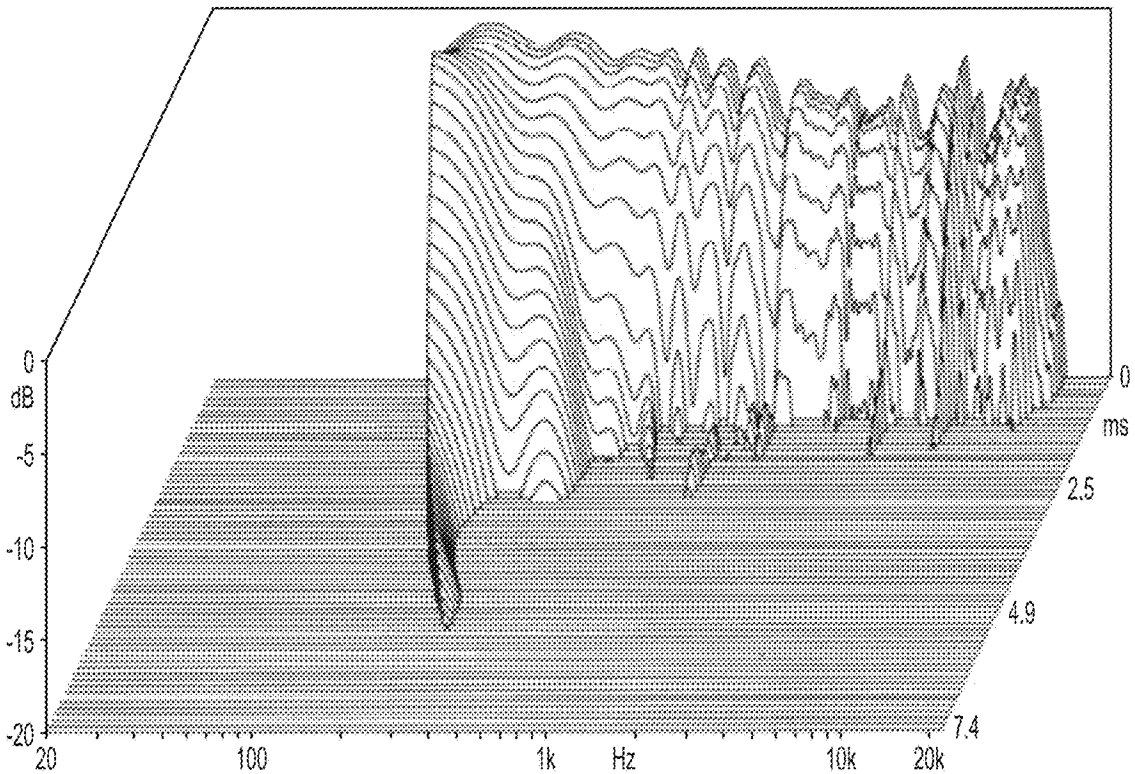
FIG. 7 is a plot of a cumulative spectral decay of an example diaphragm.

FIGS. 6 and 7 depict cumulative spectral decay results. Specifically, FIG. 6 depicts a cumulative spectral decay with respect to frequency and time of the six-inch diaphragm without any elongated openings. The time-extensive ridges at the edgehole breakup mode (roughly 1 kHz) and at 4 kHz and 6 kHz, are readily visible here, and correspond to high-Q breakup modes. These are highly audible, even after broad-band EQ, in that they interfere with the clarity of the reproduced music.

FIG. 7 depicts the same six-inch diaphragm with elongated openings totaling 4 mm wide and extending radially from central area to outer perimeter and covered with a high-loss 1 mm-thick material. More particularly, the elongated openings extend radially 7-12 mm from central area 20 to 5 mm from the outer perimeter 22 of diaphragm 10. As shown with broad-band EQ, the resulting cumulative spectral decay plot is smoother when the circumferential mode vibrations are damped and thus yields a higher quality audio output.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

The invention claimed is:

1. An acoustic transducer, comprising:

a diaphragm made of a first material having a central area and an outer perimeter, at least one elongated opening in the diaphragm extending substantially radially along a portion of a length from the central area to the outer perimeter; and a surround, comprised of a foam material having relatively higher damping characteristics than the first material, arranged circumferentially about the outer perimeter of the diaphragm, wherein the surround comprises at least one projection extending from the outer perimeter toward the central area of the diaphragm, wherein the at least one projection is arranged to cover the at least one elongated opening.

2. The acoustic transducer of claim 1, wherein the at least one projection comprises a plurality of projections and the at least one elongated opening comprises a plurality of elongated openings, each projection of the plurality of projections covering a respective elongated opening of the plurality of elongated openings.

3. The acoustic transducer of claim 1, wherein the diaphragm comprises only one elongated opening.

4. The acoustic transducer of claim 1, wherein the at least one projection covers a portion of an outer surface of the diaphragm.

5. The acoustic transducer of claim 1, further comprising at least one tinsel coupled to the diaphragm, wherein the diaphragm has a center of mass and an axis of symmetry, the at least one tinsel being and the at least one elongated opening, at least in part, being located on the opposite side of the axis of symmetry such that the center of mass of the diaphragm lies on or near the axis of symmetry.

6. The acoustic transducer of claim 1, further comprising at least one elongated depression formed in the diaphragm, extending substantially radially along a portion of a length from the central area to the outer perimeter and including a first wall, a second wall, and a floor extending between the first wall and the second wall.

* * * * *